US012808287B2

(12) United States Patent
Baillargeon et al.

(10) Patent No.: US 12,808,287 B2
(45) Date of Patent: Nov. 24, 2026

(54) DOWNHOLE CENTRIFUGAL PUMPS INCLUDING LOCKING FEATURES AND RELATED COMPONENTS AND METHODS

(71) Applicant: CHAMPIONX LLC, Sugar Land, TX (US)

(72) Inventors: David Baillargeon, Broken Arrow, OK (US); Scott Asmussen, Broken Arrow, OK (US); Michael Rumbaugh, Broken Arrow, OK (US)

(73) Assignee: CHAMPIONX LLC, Sugar Land, TX (US)

( * ) Notice: Subject to any disclaimer, the term of this patent is extended or adjusted under 35 U.S.C. 154(b) by 0 days.

(21) Appl. No.: 19/267,434

(22) Filed: Jul. 11, 2025

(65) Prior Publication Data

US 2025/0341156 A1 Nov. 6, 2025

Related U.S. Application Data

(63) Continuation of application No. 18/095,920, filed on Jan. 11, 2023, now Pat. No. 12,359,546.

(51) Int. Cl.

| | |
|---|---|
| ***E21B 43/12*** | (2006.01) |
| ***F04D 13/10*** | (2006.01) |
| ***F04D 29/42*** | (2006.01) |
| ***F04D 29/44*** | (2006.01) |

(52) U.S. Cl.

CPC ..... *E21B 43/128* (2013.01); *F04D 13/10* (2013.01); *F04D 29/426* (2013.01); *F04D 29/448* (2013.01)

(58) Field of Classification Search

CPC ..... E21B 43/128; E21B 43/121; F04D 13/10; F04D 29/426; F04D 29/448; F04D 29/445; F04D 29/628; F04D 1/06; F04D 29/669; F04D 13/08; F04D 29/20; F04D 29/444

USPC ..... 417/423.3, 423.5; 415/901, 199.2, 100, 415/199.3; 166/105.5, 106, 265, 187, 166/319, 387, 66.4

See application file for complete search history.

(56) References Cited

U.S. PATENT DOCUMENTS

| | | | | |
|---|---|---|---|---|
| 2,066,505 A * | 1/1937 | Wolfe | F04D 29/167 | 277/423 |
| 2,161,695 A * | 6/1939 | Bigelow | F04D 1/063 | 415/178 |
| 2,236,953 A * | 4/1941 | Schott | H04Q 3/42 | 415/106 |
| 2,378,974 A * | 6/1945 | Bower | F04D 29/20 | 415/199.2 |
| 3,171,630 A * | 3/1965 | Harney | F04D 13/10 | 415/100 |

(Continued)

OTHER PUBLICATIONS

U.S. Appl. No. 19/268,582, Office Action dated Jan. 15, 2026, 20 pages.

(Continued)

*Primary Examiner* — Mark A Laurenzi
*Assistant Examiner* — Benjamin Doyle
(74) *Attorney, Agent, or Firm* — BKRIP LLC

(57) ABSTRACT

Downhole centrifugal pumps and related components and methods may include stationary diffusers housing impellers where the stationary diffusers have radial sidewalls defining a radially outer portion of each of the stationary diffusers. Coupling members may be defined on the stationary diffusers to at least partially transfer a rotational force through the centrifugal pump.

20 Claims, 5 Drawing Sheets

(56) References Cited

U.S. PATENT DOCUMENTS 3,288,074 A * 11/1966 Hall ..... F04D 29/448 415/199.3
3,438,329 A * 4/1969 Fuller ..... F04D 29/448 415/199.3
3,776,664 A * 12/1973 Kimmell ..... F04D 29/445 415/901
4,227,104 A * 10/1980 Hamman ..... H02K 7/1166 310/90
4,269,564 A * 5/1981 Naffziger ..... F04D 29/4273 277/420
4,579,509 A * 4/1986 Jacobi ..... F04D 29/441 415/199.1
4,625,798 A * 12/1986 Bayh, III ..... E21B 43/128 166/319
4,981,175 A * 1/1991 Powers ..... F04D 31/00 96/214
5,320,182 A * 6/1994 Mendez ..... E21B 33/1275 166/66.4
5,482,117 A * 1/1996 Kolpak ..... E21B 43/121 166/265
5,839,205 A * 11/1998 Hung ..... F04D 17/165 417/423.5
6,004,096 A * 12/1999 Young ..... F04D 15/0083 415/146
6,106,224 A 8/2000 Sheth
6,568,904 B1 * 5/2003 Ueyama ..... F04D 29/668 415/199.2
6,872,050 B2 * 3/2005 Nenstiel ..... F04D 27/0253 415/126
7,461,692 B1 * 12/2008 Wang ..... E21B 43/128 96/216
7,887,098 B2 * 2/2011 Aas ..... E21B 17/043 285/391
8,043,051 B2 10/2011 Brunner
9,039,356 B1 5/2015 Nowitzki
9,200,642 B2 * 12/2015 Nowitzki ..... F04D 13/10
10,465,695 B2 11/2019 Patel
11,339,789 B2 5/2022 Webster
11,377,939 B1 * 7/2022 Ye ..... E21B 43/128
11,629,733 B2 * 4/2023 Eslinger ..... F04D 13/10 415/208.1
2001/0002348 A1 5/2001 Mountford
2008/0292454 A1 * 11/2008 Brunner ..... F04D 1/063 415/199.2
2012/0107114 A1 5/2012 Brunner
2013/0340245 A1 * 12/2013 Watson ..... F04D 13/08 29/592.1
2014/0262524 A1 * 9/2014 Valliyappan ..... F03B 13/02 175/57
2015/0167686 A1 * 6/2015 Baillargeon ..... F04D 29/445 415/111
2016/0090992 A1 3/2016 Jayaram
2017/0002823 A1 1/2017 Gahlot
2017/0211582 A1 * 7/2017 Patel ..... F04D 29/0416
2017/0248159 A1 * 8/2017 Rao ..... F04D 29/669
2018/0017066 A1 1/2018 Nowitzki
2018/0179861 A1 * 6/2018 Artinian ..... F04D 27/0261
2018/0195514 A1 7/2018 Cheah
2019/0285071 A1 * 9/2019 Webster ..... F04D 29/628
2019/0288442 A1 9/2019 Koparde
2019/0345920 A1 * 11/2019 Surjaatmadja ..... F04B 53/16
2020/0263703 A1 * 8/2020 Hill ..... F04D 29/44
2020/0340481 A1 10/2020 Martinez
2021/0048029 A1 * 2/2021 Ye ..... F04D 29/0473
2021/0140436 A1 * 5/2021 Ye ..... F04D 29/0416
2024/0035489 A1 * 2/2024 Rhys-Davies ..... F04D 29/601

OTHER PUBLICATIONS

U.S. Appl. No. 19/268,582, Office Action dated Sep. 9, 2026, 24 pages.

* cited by examiner

DOWNHOLE CENTRIFUGAL PUMPS INCLUDING LOCKING FEATURES AND RELATED COMPONENTS AND METHODS

CROSS REFERENCE TO RELATED APPLICATIONS

This application is a continuation of U.S. patent application Ser. No. 18/095,920, Jan. 11, 2023, for "DOWNHOLE CENTRIFUGAL PUMPS INCLUDING LOCKING FEATURES AND RELATED COMPONENTS AND METHODS," the disclosure of which is incorporated herein in its entirety by reference.

TECHNICAL FIELD

The present disclosure generally relates to pumps and, in particular, to pump diffusers of a downhole centrifugal pump including one or more locking features for at least partially resisting rotational movement of the diffusers relative to another component of the pump during the operation of a downhole centrifugal pump system.

BACKGROUND

Submersible pumps are generally used to provide "artificial lift" or artificial methods that increase upward fluid flow from downhole sources, such as production wells. In most instances, submersible pumps include a motor portion that drives a shaft coupled to impellers which are in turn rotationally coupled to diffusers. The impellers and diffusers are alternatingly situated around the shaft in a manner that causes fluid to flow from one impeller into a diffuser, and from the diffuser into another impeller as the shaft rotates. This process of fluid transfer from impeller to diffuser, and from diffuser to an adjacent upper impeller, repeats until the fluid travels from the downhole source to an upper destination.

Impellers are designed to accelerate fluid flow upwardly as the fluid is input into the pump from a fluid inlet. Diffusers are built to direct fluid flow to an adjacent upper impeller. Specifically, diffusers generally have vanes that direct the fluid flow and build fluid pressure when transferring fluid to the adjacent upper impeller. The vanes of a diffuser include a lower pressure surface that receives fluid from an adjacently lower impeller and a higher pressure surface that directs the fluid to the adjacently upper impeller. After being moved through the impellers and diffusers of the pump, the fluid exits the pump, for example, to an uphole component in a downhole string.

During the rotation the impellers and the artificial lifting of the fluid through the pump, the components of the pump may be subjected to internal and/or external forces (e.g., rotational forces) that may impact operation of the pump. For example, such forces may act to loosen and/or fail couplings and/or orientations between components of the pump. Accordingly, such forces may impact the efficiency of the pump and/or may cause operational failure of the pump.

SUMMARY

Some embodiments of the instant disclosure may relate to a downhole centrifugal pump including: impellers; a rotational shaft passing through the impellers to impart rotation to the impellers; stationary diffusers housing the impellers, the stationary diffusers including radial sidewalls defining a radially outer portion of each of the stationary diffusers, the radial sidewalls of adjacent stationary diffusers of the stationary diffusers being abutted at axial ends of the adjacent stationary diffusers; an outer housing radially encompassing the impellers, the rotational shaft, and the stationary diffusers; and coupling pins extending between and engaged with the radial sidewalls of each of the stationary diffusers, the coupling pins configured to at least partially transfer a rotational force applied to one or more of the stationary diffusers to the remaining stationary diffusers; wherein an end diffuser of the stationary diffusers is coupled to an adjacent component to at least partially transfer the rotational force applied to the one or more of the stationary diffusers through the stationary diffusers to the adjacent component.

Some embodiments of the instant disclosure may relate to a centrifugal pump including: impellers; a rotational shaft passing through the impellers to impart rotation to the impellers; a stack of diffusers housing the impellers, the stack of diffusers including sidewalls defining a radially outer portion of each of the stack of diffusers; and coupling members, each coupling member at least partially securing one diffuser of the stack of diffusers to an adjacent diffuser of the stack of diffusers, the coupling members configured to at least partially transfer rotational forces applied to one or more diffusers of the stack of diffusers to a remaining portion of the stack of diffusers.

Some embodiments of the instant disclosure may relate to a method of assembling a centrifugal pump, the method including: forming a stack of a plurality of diffusers by positioning radial sidewalls of the plurality of diffusers adjacent to each other; housing a plurality of impellers in the plurality of diffusers; extending a rotational shaft through the plurality of impellers to impart rotation to the plurality of impellers; extending coupling pins between the radial sidewalls of each of the plurality of diffusers to at least partially secure each of the plurality of diffusers to reduce, limit, restrict, at least partially prevent, and/or minimize relative rotation between the plurality of diffusers; and anchoring an end diffuser of the plurality of diffusers coupled to an adjacent component of the centrifugal pump.

BRIEF DESCRIPTION OF THE DRAWINGS

The accompanying drawings illustrate a number of exemplary embodiments and are a part of the specification. Together with the following description, these drawings demonstrate and explain various principles of the instant disclosure.

DETAILED DESCRIPTION

Figure 1:
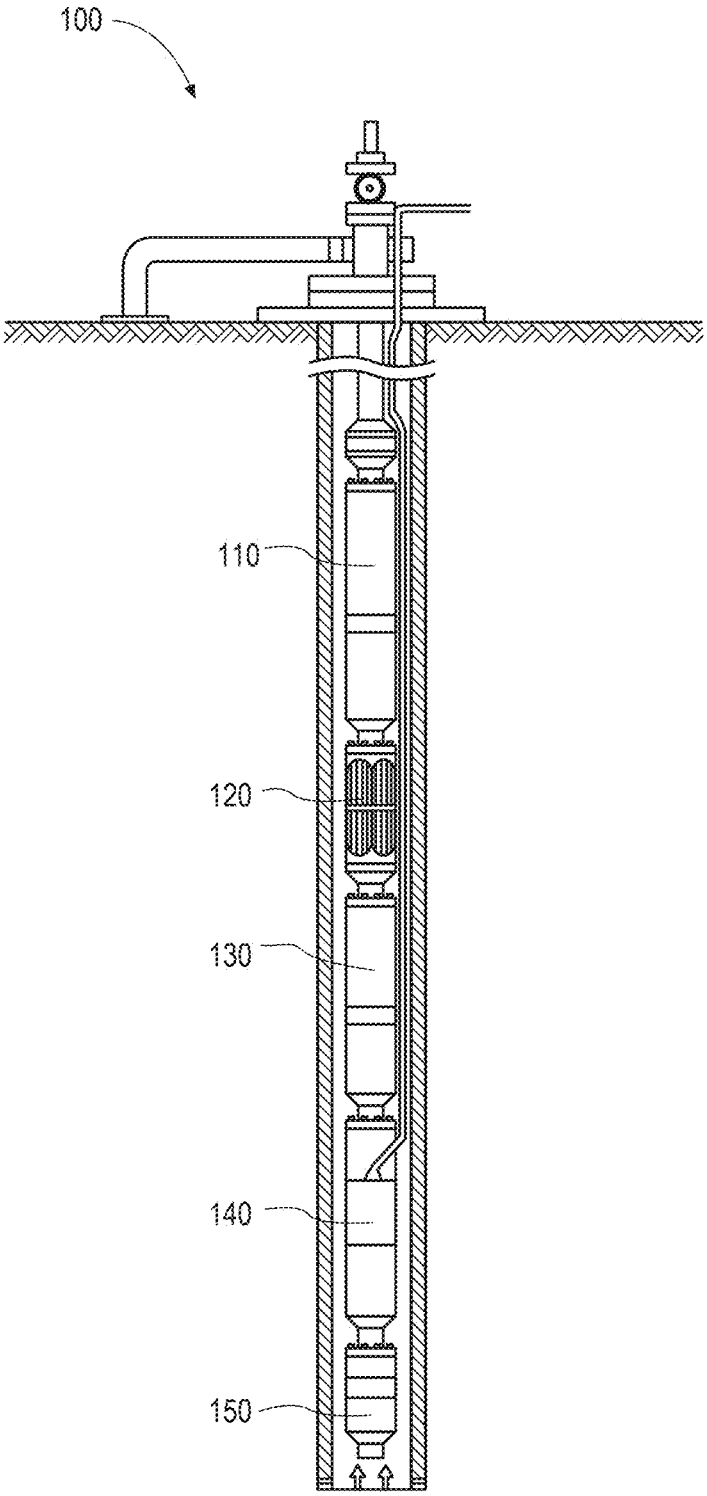
FIG. 1 is a simplified side or elevation view of a downhole centrifugal pump system according to an embodiment of the disclosure.

As used herein, relational terms, such as "first," "second," "top," "bottom," etc., are generally used for clarity and convenience in understanding the disclosure and accompanying drawings and do not connote or depend on any specific preference, orientation, or order, except where the context clearly indicates otherwise.

As used herein, the term "and/or" means and includes any and all combinations of one or more of the associated listed items.

As used herein, the terms "vertical," "lateral," "radial," "uphole," and "downhole" refer to the orientations as depicted in the figures.

Embodiments of the instant disclosure are directed to exemplary fluid handling devices (e.g., pumps) that include one or more locking features. Such locking features may act to at least partially maintain (e.g., substantially maintain, substantially prevent movement) the position of one or more components of the fluid handling device.

For example, a pump (e.g., a submersible pump, an electric submersible pump (ESP), a centrifugal pump, a multistage centrifugal pump, or any suitable pump, without limitation) may include or be coupled to a motor that drives a shaft coupled to impellers which are, in turn, rotationally coupled to diffusers. The impellers and diffusers are alternatingly situated around the shaft in a manner that causes fluid to flow from one impeller into a diffuser, and from the diffuser into another impeller as the shaft rotates. This process of fluid transfer from impeller to diffuser, and from diffuser to an adjacent upper impeller, repeats until the fluid travels from the downhole source to an upper destination.

In such a configuration, the diffusers are intended to remain substantially (e.g., entirely) stationary while the impellers and the shaft rotate within the diffusers. In some applications, adjacent diffusers may be coupled together using an interference fit and/or a compression fit. For example, the diffusers may be heated to expand the material forming the coupling sections and assembled. Once cooled, the diffusers may form a relatively tight fit to hold the diffusers together and minimize movement relative to one another (e.g., via friction between the coupled diffusers).

However, during use, the couplings or connections between adjacent diffusers may begin to degrade, enabling movement (e.g., rotational movement) of the diffusers (e.g., relation to adjacent diffusers or other stationary components). Such movement of the diffusers may be relatively more common in relatively high heat applications where deformation (e.g., expansion) of the diffusers may loosen the couplings in between the diffusers and enable relative movement between diffusers. For example, during high heat applications and/or thermal cycling, expansion may deform the diffusers (e.g., permanent, plastic deformation). In additional embodiments, manufacturing defects, wear, damage, and/or other defects may cause the diffusers to begin rotating.

In accordance with some embodiments of the disclosure, one or more locking features (e.g., mechanical stops) may be implemented in such pumps to at least partially ensure that the diffusers remain in a stationary configuration where the diffusers do not substantially move relative to one another or other components while the impellers and shaft are rotated by a motor to operate the pump. For example, as discussed below, one or more pins may be positioned to extend between adjacent diffusers in order to resist or minimize (e.g., substantially prevent) rotational movement of or between the diffusers. At one or more ends of a stack of diffusers, another locking feature (e.g., a differing locking feature) may be implemented to couple the stack of diffusers to an anchoring component (e.g., a pump base). Such a locking feature provided at least partially be the end diffuser may act to assist in stopping the rotation of the entire stack of diffuser in unison as each diffuser to coupled via the locking feature.

Such locking features may be of particular use in applications where the pump is implemented in high heat environments and/or where the fluid being pumped includes a relatively high amount of fluid that is in an at least partially gaseous state. Such an environment may include a relatively higher amount of gas intermittently flowing or flowing in a substantially constant stream through the pump. In embodiments where a submersible pump is implemented, the pump may at least partially lack a separate lubrication or working fluid. Such a pump configuration at least partially relies on the process fluid being supplied through the pump to cool one or more components of the pump. As a result, in a relatively high gas environment where adequate lubrication may be intermittent or relatively less reliable, the components of the pump may be subjected to periods of relatively high heating that increase the probability of the diffusers becoming dislodged and beginning to move. Embodiments of the instant disclosure including one or more locking features may enable the reduction of efficiency and/or failure of the pump due to movement in the diffusers even in such high gas applications.

As discussed below, in some embodiments, the diffusers may be coupled using a nonthreaded coupling device, such as, for example, a pin (e.g., protrusion) that is received in (e.g., slidingly received in) a complementary recess in the diffusers (e.g., a blind hole). The use of such nonthreaded pins or protrusions may enable relatively simplified manufacture, assembly, and/or disassembly of the diffuser stack. In some embodiments, the use of such nonthreaded pins or protrusions may enable the use of blind holes that extend through only a minor portion of the diffuser sidewall and eliminate the need to form through-holes through the pump where the diffusers may exhibit a relatively thinner sidewall. For example, in some applications, the pump may have a relatively smaller overall width or diameter (e.g., less than 10 inches (25.4 centimeters), 2 inches to 6 inches (5.08 to 15.24 centimeters), 4 inches (10.16 centimeters)) where bulky connectors (e.g., bolts, etc.) may not be practical due to the available wall thickness and the applied forces. The use of such nonthreaded pins or protrusions may also provide a relatively reduced diameter where the need for external connectors and/or flanged connection portions between the diffusers may be eliminated.

In some embodiments, an end diffuser (e.g., a lowermost diffuser as the pump is positioned in use as in FIG. 1) may include a locking feature to couple with the remaining diffusers positioned above the end diffuser. The end diffuser may include such an additional locking feature (e.g., one or more protrusions and/or slots) that engages with complementary locking features on an adjacent component. For example, the locking feature of the end diffuser may engage with another downhole component or another portion of the pump that is firmly mounted (e.g., welded, coupled with fasteners, etc.) in a manner to minimize rotation of the stack of diffusers.

FIG. 1 is a simplified side or elevation view of a downhole centrifugal pump system. Downhole centrifugal pump systems generally include at least a downhole structure housing a pump coupled to a motor. In some implementations, the downhole structure may include a plurality of pumps coupled to a plurality of motors. Depending on the use scenario, the downhole structure can be submerged in one or more fluid sources (e.g., oil or gas reservoir, aquifer, etc.) as needed. The plurality of pumps in the downhole structure may upwardly pump the fluid from the fluid source to receiving containers (e.g., tanks, vessels, etc.) at a higher elevation relative to the fluid source.

As shown in FIG. 1, the downhole centrifugal pump system 100 may include one or more pumps 110, one or more gas handling devices 120, one or more protector devices 130, one or more motors 140, and one or more monitoring devices 150.

Figure 2:
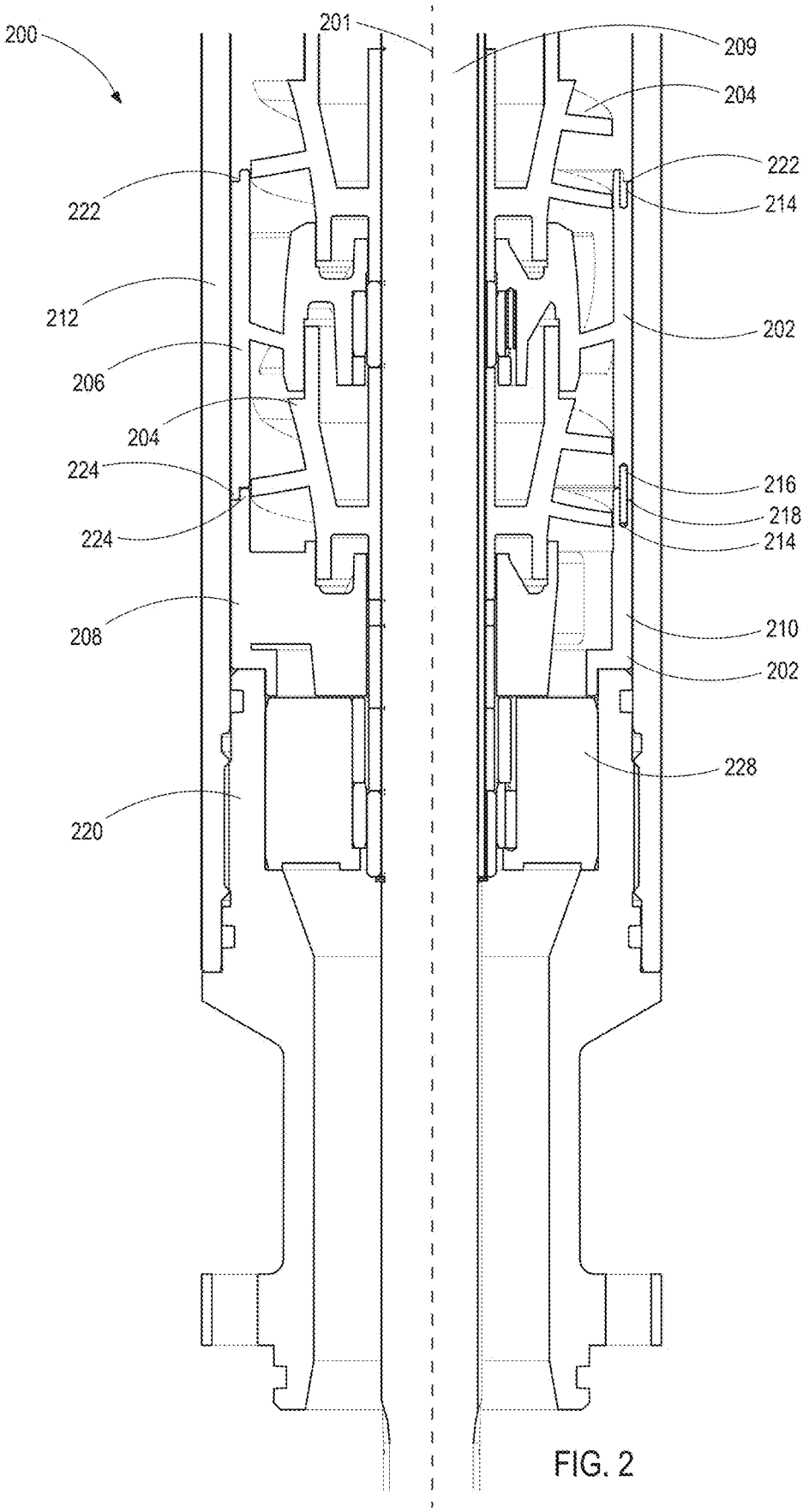
FIG. 2 is a cross-sectional view of a portion of a centrifugal pump according to an embodiment of the disclosure.

The pump 110 may include a series of impellers and diffusers that are alternatingly coupled to each other. For example, and as shown in FIG. 2, the series of impellers and diffusers of the pump 110 may include impellers 204 rotationally coupled to associated diffusers 202. As above, in some implementations, the pump 110 may be an electric submersible pump (ESP) configured to operate in high-volume wells and/or horizontal or highly deviated wells. For example, the pump 110 may facilitate fluid production from 150 barrels per day (BPD) to 10,000 BPD and may range in size from 2 inches to more than 7 inches (5.08 to 17.78 centimeters) in diameter (e.g., 4 inches (10.16 centimeters)). This wide specification range allows the pump 110 to be adaptable to varying drilling conditions. Additionally, the pump 110 may be abrasion-resistant and may enable the ability to handle solids in, for example, high sand production scenarios.

Turning back to FIG. 1, the gas handling device 120 may be configured to mitigate against gas locking by reducing gas interference in the pump 110. In some implementations, the gas handling device 120 may incorporate rotary and vortex gas separators that enhance pump efficiency by preventing free gas from entering the pump 110 in the first place. Operations executed by the gas handling device 120 maximize fluid production by lowering pump drawdown and facilitating well uptime.

The protector device 130 may be configured to ensure electrical and mechanical integrity of the motor 140. The motor 140 (e.g., an electric motor, a hydraulic motor, an internal combustion engine, another type of prime mover, etc.) may operate the pump 110 by rotating one or more shafts that run through the length of pump 110 and that are coupled to impellers disposed in respective diffusers of the pump 110.

In some implementations, the protector device 130 may act as an oil reservoir that facilitates the expansion capacity of the motor 140. The protector device 130 may include a secure seal that keeps the motor 140 running smoothly. Additionally, the protector device 130 may further include one or more chambers adapted to prevent wellbore fluid contamination of the motor 140 by creating a low-pressure boundary between the well fluid and the clean oil used to lubricate the motor 140. Moreover, the protector device 130 may facilitate: torque transfer from the motor shaft to the gas handling device 120 and/or pump intake shaft; reinforcement of the pump shaft; and adaptation of the downhole centrifugal pump system 100 to specific implementation considerations.

The motor 140 may be configured to drive a shaft coupled to the pump 110 of the downhole centrifugal pump system 100. In some embodiments, the motor 140 may be an electric submersible motor configured for variable-speed operations, high temperature tolerance, and deep well pumping. The motor 140 may include one or more circuitry that allows 3-phase operations, 2-pole inductions, etc. The motor 140 may be fabricated using corrosion resistant materials such as stainless steel.

The monitoring device 150 may include software and/or firmware and other hardware that enables monitoring of the downhole centrifugal pump system 100. In some embodiments, the monitoring device 150 may include one or more sensors (e.g., temperature sensors, pressure sensors, etc.) that capture a plurality of information during the operation of the downhole centrifugal pump system 100. This information may be transmitted via a wired and/or wireless channel to user interfaces that facilitate viewing of monitoring data associated with various operations of the downhole centrifugal pump system 100 and/or conditions in which the downhole centrifugal pump system 100 operates.

FIG. 2 is a cross-sectional view of a portion of a centrifugal pump 200 having a longitudinal axis 201. As shown in FIG. 2, the centrifugal pump 200 may include a stack of diffusers 202 with impellers 204 positioned in the stack of diffusers 202. For clarity, only two diffusers 202 are shown (e.g., a middle diffuser 206 and an end diffuser 208). However, any number of diffusers 202 may be implemented with the diffusers 202, for example, with a repeated stack of middle diffusers 206 extending to another end (e.g., an upper outlet) of the centrifugal pump 200.

As discussed above, the centrifugal pump 200 may include or be coupled to a motor that drives (e.g., rotates) a shaft 209. The shaft 209 is coupled to the impellers 204 in order to rotate the impellers 204 within the diffusers 202. Rotation of the impellers 204 within the diffusers 202 acts to drive fluid through the centrifugal pump 200. For example, in a downhole application, the impellers 204 drive the fluid from a lowermost portion of the centrifugal pump 200 where the fluid is supplied through an inlet to a fluid outlet at an uppermost portion of the centrifugal pump 200. In a downhole application, such a configuration may assist in moving the fluid up through the borehole to a location more proximate to a surface of the well.

Each of the diffusers 202 may include an outer portion (e.g., radial sidewall 210) that collectively defines an outer circumference of the stack of diffusers 202. The diffusers 202 may be received within an outer housing 212 of the centrifugal pump 200. Each of the diffusers 202 may include an opening 214 (e.g., a blind hole) for receiving a protrusion (e.g., pin 216) extending from an adjacent diffuser 202. For example, the openings 214 may be defined in the radial sidewall 210 of each of the diffusers 202.

As depicted, the pins 216 may be a structure separate from the diffusers 202. However, in additional embodiments, such as that discussed below, the pins 216 may be an integral protrusion of any suitable shape that is formed with the diffusers 202 and may be received in (e.g., secured in) a complementary opening 214 (e.g., recess, hole, depression) of an adjacent diffuser 202. Further, the pins 216 may be of any suitable shape, whether integrated or separate, in order to be received in a respective opening 214 of an adjacent diffuser 202. For example, the pins 216 may be substantially cylindrical (e.g., as depicted), cuboid, or any other polygonal or suitable shape.

Where separable pins 216 are implemented, each middle diffuser 206 may include two openings 214, each positioned on either axial side of the middle diffuser 206 in order to couple with adjacent uphole and/or downhole diffusers 202. The end diffuser 208 may include only one opening 214 oriented in an uphole direction toward the adjacent middle diffuser or diffusers 206. In some embodiments, an end diffuser 208 at the other end of the centrifugal pump 200 (e.g., an uphole end) may include a similar configuration as the end diffuser 208.

In some embodiments, only one pin 216 or other protrusion may be implemented at the interface 218 of adjacent diffusers 202. In additional embodiments, multiple pins 216 or other protrusions may be implemented at the interface 218 of adjacent diffusers 202 to secure the diffusers 202.

The adjacent diffusers 202 (e.g., middle diffuser 206 and end diffuser 208) are aligned with the pin 216, which may extend at least partially along the longitudinal axis 201. Rotational force (e.g., torque) applied to one or more of the diffusers 202 may be transferred to the next diffuser 202 until it reaches the last diffuser (e.g., end diffuser 208). In such a configuration, individual rotation of the diffusers 202 relative to each other will be minimized or substantially eliminated as the applied rotational force will generally be required to rotate all connected diffusers 202 together due to the unifying coupling provided by the pins 216.

Figure 4:
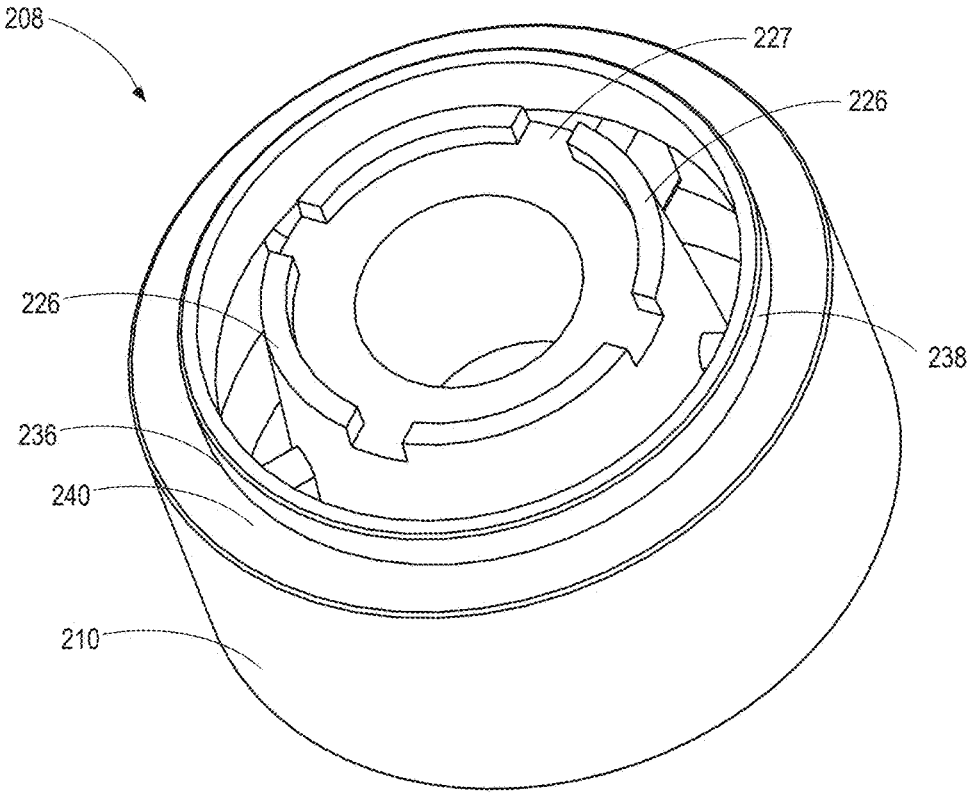
FIG. 4 is a second perspective view of an end diffuser of a centrifugal pump according to an embodiment of the disclosure.

As noted above, the stack of diffusers 202 (e.g., the stack of middle diffusers 206 and one or more end diffusers 208) may be anchored to an adjacent end structure (e.g., a pump base 220). In some embodiments, the manner of attachment may be different than the attachment of the diffusers 202. For example, the end diffuser 208 may include a number of protrusions (e.g., a castellated feature as shown in FIG. 4) that engages with an adjacent structure (e.g., the pump base 220).

In some embodiments, axial ends of the diffusers 202 may include an engagement feature (e.g., a stepped surface 222) that contacts an opposing complementary stepped surface 222 of an adjacent diffuser 202. The stepped surface 222 of each diffuser 202 may include an axially extending flange 224 positioned proximate to an inner radial portion or an outer radial portion of the sidewall 210 of the respective diffuser 202. For example, the stepped surface 222 of a diffuser 202 (e.g., middle diffuser 206) may engage with the reversed stepped surface 222 an adjacent diffuser 202 (e.g., end diffuser 208) to at least partially secure the diffusers 202 (e.g., in the radial direction). As depicted, the stepped surface 222 may be nonplanar. For example, the stepped surface 222 may extend along multiple planes that are orthogonal and/or transverse to the longitudinal axis 201.

Where the flange 224 is implemented, the pins 216 may provide a discontinuous attachment feature about a circumference of the radial sidewall 210 of the diffusers 202 in order to at least partially prevent rotational movement as compared to the flange 224 that is substantially continuous about the circumference of the radial sidewall 210 of the diffusers 202.

As depicted, the openings 214 may extend through the stepped surface 222 such that a proximate portion of the opening 214 (e.g., an entrance of the opening 214) is defined on only one radial side by a respective axially extending flange 224.

Figure 3:
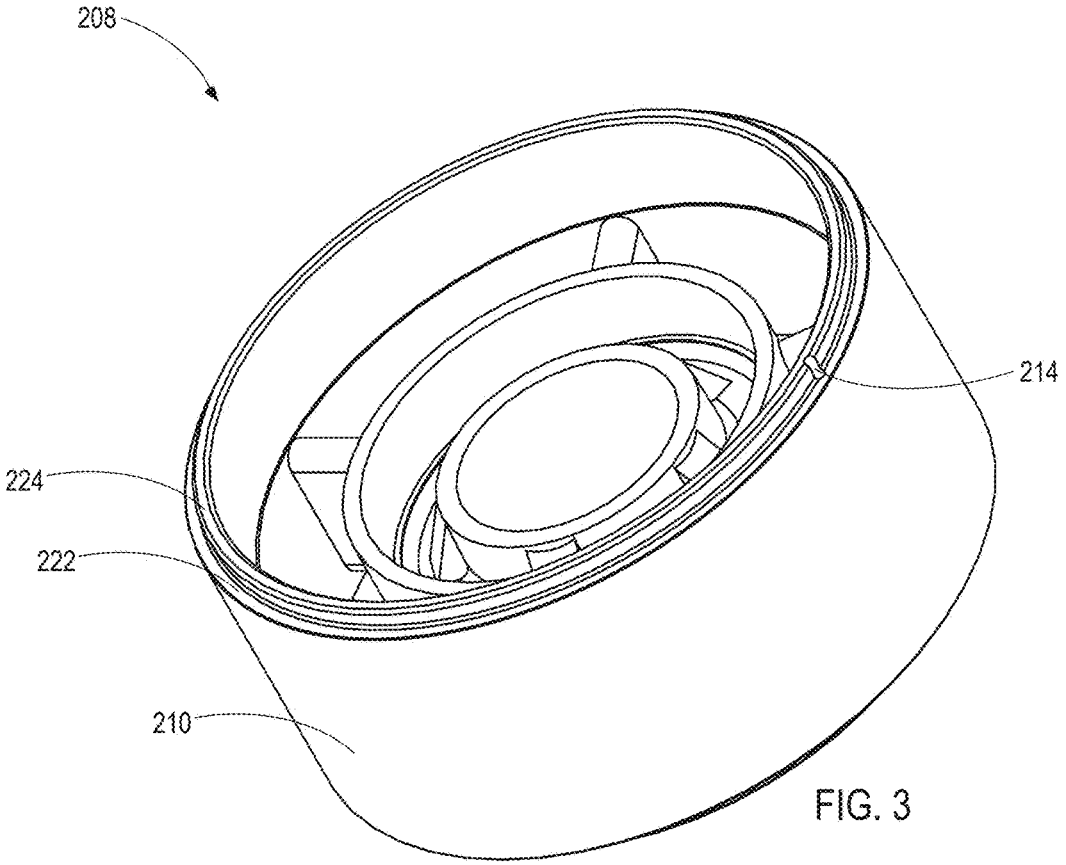
FIG. 3 is a first perspective view of an end diffuser of a centrifugal pump according to an embodiment of the disclosure.

FIG. 3 is a first perspective view of an end diffuser of a centrifugal pump, which, in some embodiments, may be similar to the end diffuser 208 of the centrifugal pump 200. As shown in FIG. 3, the opening 214 is formed as a blind hole with a portion defined through the flange 224 of the stepped surface 222 where only one radial side of the opening 214 is defined due to the stepped surface 222 of the end diffuser 208.

FIG. 4 is a second perspective view of an end diffuser of a centrifugal pump, which, in some embodiments, may be similar to the end diffuser 208 of the centrifugal pump 200. As shown in FIG. 4, the end diffuser 208 may be anchored to an adjacent end structure (e.g., the pump base 220 (FIG. 2)) via a manner of attachment that is different than the attachment of the diffusers 202. For example, the end diffuser 208 may include one or more protrusions 226 (e.g., a castellated feature including two or more protrusions 226) that engage with a complementary portion of the pump base 220 (e.g., one or more openings or recesses in the pump base 220). The one or more protrusions 226 may define recesses 227 between the protrusions 226 for receiving a portion of the pump base 220 (e.g., ribs 232 as discussed below). In additional embodiments, the pump base 220 or both the end diffuser 208 and the pump base 220 may include interlocking features, such as the protrusions 226.

In some embodiments, the end diffuser 208 may include a stepped surface 236 where a flange 238 of the stepped surface 236 may be received in the pump base 220 while abutting another radially extending portion 240 of the stepped surface 236.

Figure 5:
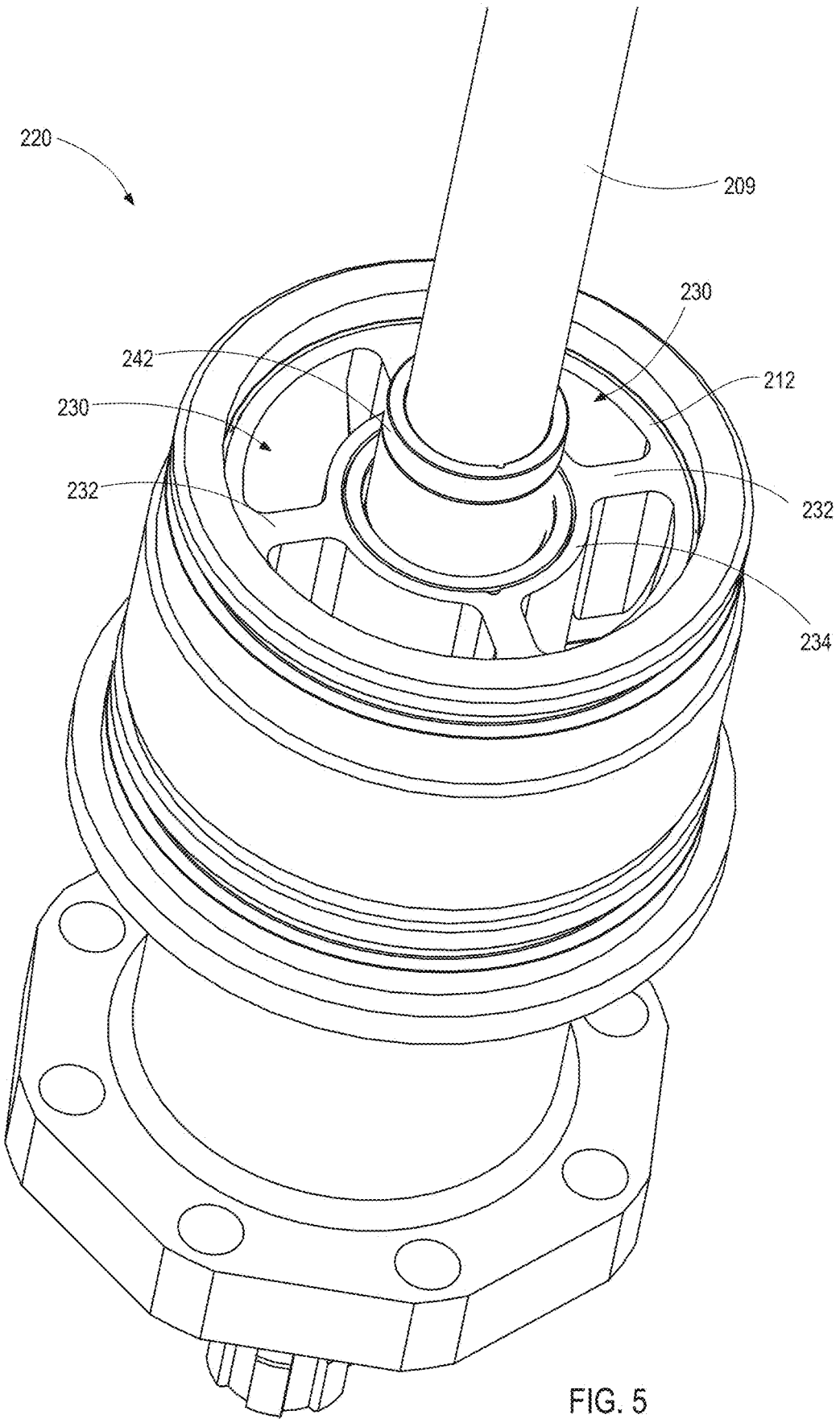
FIG. 5 is a perspective view of a pump base of a centrifugal pump according to an embodiment of the disclosure.

FIG. 5 is a perspective view of a pump base of a centrifugal pump, which, in some embodiments, may be similar to the pump base 220 of the centrifugal pump 200. As shown in FIG. 5, the pump base 220 may include an insert 228 including one or more features to engage with the one or more protrusions 226 of the end diffuser 208. Referring to FIGS. 4 and 5, the insert 228 may include one or more openings 230 defined between ribs 232 that may receive the one or more protrusions 226 of the end diffuser 208 while the ribs 232 are received in the recesses 227 between the one or more protrusions 226 of the end diffuser 208.

Such a configuration may provide a secure connection with an interference fit (e.g., optionally with a high temperature locking compound) in order to transfer (e.g., anchor) the rotational forces from the stack of the diffusers 202 at the interface between the end diffuser 208 and the pump base 220 to secure the stack of diffusers 202.

In some embodiments, a central portion 234 of the insert 228 may hold a bearing element 242 that stabilizes the shaft 209 and in which the shaft 209 may rotate along while also defining the one or more openings 230 for engagement with the one or more protrusions 226 of the end diffuser 208.

Figure 6:
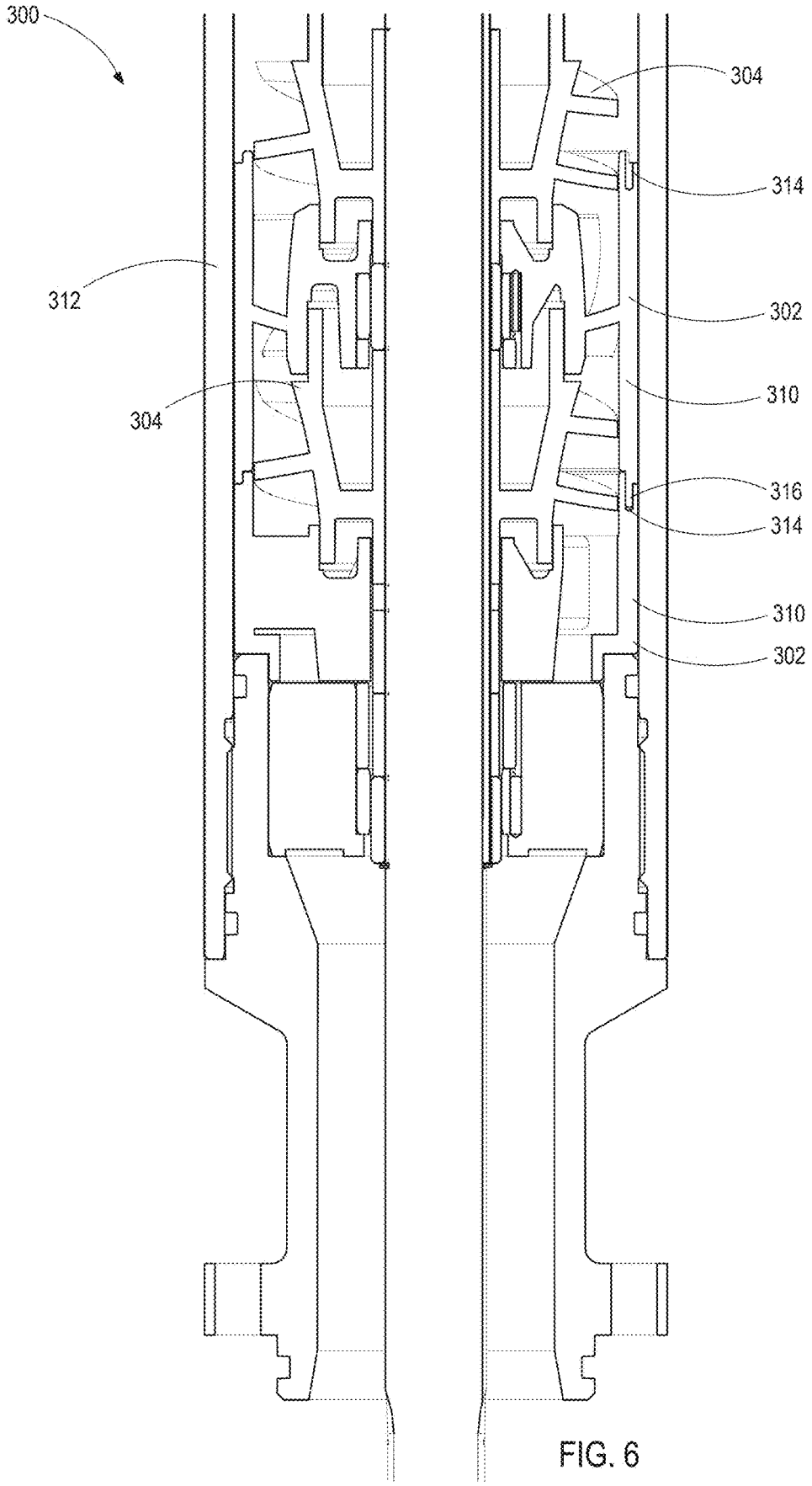
FIG. 6 is a cross-sectional view of a portion of a centrifugal pump according to an embodiment of the disclosure.

FIG. 6 is a cross-sectional view of a portion of a centrifugal pump 300, which, in some embodiments, may be similar to and include one or more components of the centrifugal pump 200 discussed above. As shown in FIG. 6, the centrifugal pump 300 may include a stack of diffusers 302 with impellers 304 positioned in the stack of diffusers 302.

Each of the diffusers 302 may include a sidewall 310 that collectively defines an outer circumference of the stack of diffusers 302. The diffusers 202 may be received within an outer housing 312 of the centrifugal pump 300. Each of the diffusers 302 may include an opening 314 (e.g., a blind hole) for receiving an integrated protrusion (e.g., an axially extending pin 316 or post) extending from an adjacent diffuser 302. As discussed above, the pins 316 may be an integral protrusion of any suitable shape that is formed with the diffuser 302 and may be received in the opening 314 of an adjacent diffuser 302.

As depicted, the axial ends of the diffusers 302 may include the axially extending pin 316 on one end and the opening 314 on the other opposing end such that the diffusers 302 may be easily stacked in the correct orientation during assembly.

Embodiments of the disclosure may include methods of assembling or reassembling a pump with stages of diffusers and impellers (e.g., centrifugal pump such as that discussed above). Referring to FIGS. 2 and 6, such a method may include housing the impellers 204, 304 in the diffusers 202, 302 where the impellers 204, 304 are mounted on the rotational shaft 209 passing through the impellers 204, 304 to impart rotation to the impellers 204, 304. A stack of the diffusers 202, 302 may be defined or formed by positioning radial sidewalls 210, 310 of the diffusers 202, 302 adjacent to each other.

Coupling pins 216, 316 may be extended between the radial sidewalls 210, 310 of each of the diffusers 202, 302 to at least partially secure each of the diffusers 202, 302 to minimize relative rotation between the diffusers 202, 302. An end diffuser 208, 302 of the diffusers 202, 302 may be anchored by coupling the end diffuser 208, 302 to an adjacent component of the centrifugal pump 200, 300 (e.g., the pump base 220).

Terms of degree (e.g., "about," "substantially," "generally," etc.) indicate structurally or functionally insignificant variations. In an example, when the term of degree is included with a term indicating quantity, the term of degree is interpreted to mean±10%, ±5%, or ±2% of the term indicating quantity. In an example, when the term of degree is used to modify a shape, the term of degree indicates that the shape being modified by the term of degree has the appearance of the disclosed shape. For instance, the term of degree may be used to indicate that the shape may have rounded corners instead of sharp corners, curved edges instead of straight edges, one or more protrusions extending therefrom, is oblong, is the same as the disclosed shape, et cetera.

While the present disclosure has been described herein with respect to certain illustrated embodiments, those of ordinary skill in the art will recognize and appreciate that it is not so limited. Rather, many additions, deletions, and modifications to the illustrated embodiments may be made without departing from the scope of the disclosure as hereinafter claimed, including legal equivalents thereof. Further, the words "including," "having," and variants thereof (e.g., "includes" and "has") as used herein, including the claims, shall be open-ended and have the same meaning as the word "comprising" and variants thereof (e.g., "comprise" and "comprises"). In addition, features from one embodiment may be combined with features of another embodiment while still being encompassed within the scope of the disclosure as contemplated by the inventors.

What is claimed is:

1. A downhole centrifugal pump, comprising:
at least one impeller;
a rotational shaft passing through the at least one impeller to impart rotation to the at least one impeller;
a pump base defining a plurality of openings and comprising a plurality of ribs partially defining and separating the plurality of openings, wherein the plurality of ribs are arranged extending radially between an outer housing of the pump base and a central portion of the pump base; and
an end diffuser comprising at least one protrusion extending axially into at least one opening of the plurality of openings of the pump base, the at least one protrusion configured to inhibit rotation of the end diffuser relative to the pump base by engaging with a portion of the pump base defining the at least one opening.

2. The downhole centrifugal pump of claim 1, wherein the at least one protrusion comprises a plurality of protrusions on the end diffuser.

3. The downhole centrifugal pump of claim 2, wherein in each protrusion of the plurality of protrusions of the end diffuser extends into a respective opening of the plurality of openings in the pump base.

4. The downhole centrifugal pump of claim 3, wherein the plurality of protrusions of the end diffuser are arranged to define castellations.

5. The downhole centrifugal pump of claim 3, wherein each of the plurality of protrusions of the end diffuser are arcuate protrusions.

6. The downhole centrifugal pump of claim 3, wherein the plurality of protrusions are separated by a plurality of recesses defined in the end diffuser.

7. The downhole centrifugal pump of claim 6, wherein each rib of the plurality of ribs of the pump base extends into a respective recess of the plurality of recesses defined in the end diffuser.

8. The downhole centrifugal pump of claim 1, wherein a portion of the pump base defining the plurality of ribs and the plurality of openings is recessed within an axial end of the pump base.

9. The downhole centrifugal pump of claim 8, wherein a portion of the end diffuser defining the at least one protrusion is at least partially received within the axial end of the pump base.

10. A centrifugal pump, comprising:
at least one impeller;
a rotational shaft passing through the at least one impeller to impart rotation to the at least one impeller; and
an end diffuser comprising:
an outer ring comprising a flange configured to engage with an outer portion of an adjacent component of the centrifugal pump at a first radially outer location; and
an inner ring radially spaced and separated from the outer ring, the inner ring defining interlocking features, the interlocking features of the end diffuser configured to engage with the adjacent component of the centrifugal pump at a second radially interior location, the interlocking features further configured to axially overlap with complementary interlocking features of the adjacent component to inhibit rotation of the end diffuser relative to the adjacent component.

11. The centrifugal pump of claim 10, wherein the interlocking features are configured to align and interlock at a plurality of angular positions of the end diffuser relative to the adjacent component.

12. The centrifugal pump of claim 10, wherein the adjacent component comprises a pump base.

13. The centrifugal pump of claim 12, wherein the flange defines a stepped surface on the end diffuser.

14. A method of assembling a centrifugal pump, the method comprising:
arranging a plurality of diffusers comprising an end diffuser in a stack;
positioning at least one impeller in the plurality of diffusers;
coupling a rotational shaft to the at least one impeller; and
positioning interlocking features of the end diffuser and a pump base to axially overlap and inhibit rotation of the end diffuser relative to the pump base, the interlocking features of the end diffuser being positioned at a radially internal location of the end diffuser to interlock with the interlocking features of the pump comprising ribs extending radially between an outer housing and a central portion of the pump.

15. The method of claim 14, wherein positioning the interlocking features of the end diffuser and the pump base to axially overlap comprises positioning castellations of the end diffuser within openings in the pump base.

16. The method of claim 15, further comprising positioning ribs of the pump base into recesses of the castellations of the end diffuser.

17. The method of claim 16, wherein positioning ribs of the pump base into recesses of the castellations of the end diffuser further comprises positioning a rib of a plurality of ribs of the pump base into each recess of the castellations.

18. The centrifugal pump of claim 10, wherein the interlocking features of the end diffuser are configured to engage with the complementary interlocking features of the adjacent component comprising ribs at the second radially interior location.

19. The centrifugal pump of claim 18, wherein the ribs of the adjacent component extend radially between an outer housing of the adjacent component and a central portion of the adjacent component.

20. The centrifugal pump of claim 10, wherein the interlocking features of the end diffuser are positioned at the second radially interior location in order to engage with the complementary interlocking features of the adjacent component that extend radially between an outer housing and a central portion of the adjacent component.

* * * * *